US008896140B2

(12) United States Patent
Venkatasubramaniam et al.

(10) Patent No.: US 8,896,140 B2
(45) Date of Patent: Nov. 25, 2014

(54) CIRCUIT CONFIGURATION FOR A STARTING DEVICE

(75) Inventors: Balasubramaniam Venkatasubramaniam, Stuttgart (DE); Sven Hartmann, Stuttgart (DE); Stefan Tumback, Stuttgart (DE); Falco Sengebusch, Stuttgart-Feuerbach (DE); Roman Pirsch, Koengen (DE)

(73) Assignee: Robert Bosch GmbH, Stuttgart (DE)

( * ) Notice: Subject to any disclaimer, the term of this patent is extended or adjusted under 35 U.S.C. 154(b) by 355 days.

(21) Appl. No.: 13/389,963

(22) PCT Filed: Jul. 2, 2010

(86) PCT No.: PCT/EP2010/059428
§ 371 (c)(1),
(2), (4) Date: Apr. 20, 2012

(87) PCT Pub. No.: WO2011/018275
PCT Pub. Date: Feb. 17, 2011

(65) Prior Publication Data

US 2012/0200093 A1 Aug. 9, 2012

(30) Foreign Application Priority Data

Aug. 12, 2009 (DE) ..... 10 2009 028 465
Dec. 8, 2009 (DE) ..... 10 2009 047 635

(51) Int. Cl.
*F02N 11/00* (2006.01)

(52) U.S. Cl.
USPC ..... 290/38 R; 290/31

(58) Field of Classification Search
USPC ..... 290/38 R, 31, 32, 36 R
See application file for complete search history.

(56) References Cited

U.S. PATENT DOCUMENTS

| | | | | |
|---|---|---|---|---|
| 5,731,638 | A | 3/1998 | Niimi | |
| 7,804,180 | B2 * | 9/2010 | Labbe et al. | 290/38 R |
| 8,258,639 | B2 * | 9/2012 | Labbe et al. | 290/38 A |
| 8,272,360 | B2 * | 9/2012 | Hartmann et al. | 123/179.3 |
| 8,344,530 | B2 * | 1/2013 | Nakayama et al. | 290/38 R |
| 8,487,457 | B2 * | 7/2013 | Fujisawa et al. | 290/38 R |
| 8,492,916 | B2 * | 7/2013 | Murata et al. | 290/38 R |
| 2012/0186551 | A1 * | 7/2012 | Rentschler et al. | 123/179.3 |
| 2013/0088011 | A1 * | 4/2013 | Rentschler et al. | 290/48 |

FOREIGN PATENT DOCUMENTS

| | | |
|---|---|---|
| CN | 1334403 | 2/2002 |
| DE | 102 31 088 | 1/2004 |
| DE | 103 17 466 | 12/2004 |
| WO | WO 91/00960 | 1/1991 |

* cited by examiner

*Primary Examiner* — Nicholas Ponomarenko
(74) *Attorney, Agent, or Firm* — Kenyon & Kenyon LLP

(57) ABSTRACT

A circuit configuration for an electric machine, e.g., a starter motor for starting an internal combustion engine in a motor vehicle, includes a current limiting device for limiting a starting current of the electric machine. The circuit configuration includes a bridging device for bridging the current limiting device.

24 Claims, 6 Drawing Sheets

CIRCUIT CONFIGURATION FOR A STARTING DEVICE

BACKGROUND OF THE INVENTION

1. Field of the Invention

The present invention relates to a circuit configuration for an electric machine, e.g., a starter motor for starting an internal combustion engine in a motor vehicle, including a current limiting device for limiting a starting current of the electric machine, and the present invention also relates to a method for operating a circuit configuration of this type.

2. Description of Related Art

Starting devices which are configured to have a starter motor according to the principle of a direct-current machine which uses mechanical commutation, in particular as a rotating-armature machine, are used for starting internal combustion engines in motor vehicles.

To achieve a necessary high torque and a high power of the starter at a comparatively low vehicle electrical system voltage of approximately 12 V to 14 V, or 24 V to 28 V, the direct-current machine is equipped with a small number of windings and a large line cross section. Due to the resulting low impedance, i.e., that of a rotor or also of a stator depending on the specific embodiment, the power loss is reduced and a high torque output is achieved at a comparatively good efficiency. On the other hand, it is the low impedance and, in particular, the low ohmic resistance, as well as the low inductivity, which result in high starting currents and a temporary voltage drop in a battery-operated vehicle electrical system. Only when the starter motor starts up is a voltage induced as the rotational speed increases, which counteracts the voltage drop. Additional consumers, which are connected to other points on the vehicle electrical system, must be designed for this voltage drop, or they must be inactive at the time of the voltage drop.

In conventional starting systems, the voltage drop during the startup is usually not critical, since additional consumers are largely not yet active or are inactive. In starter-based start-stop systems, in which the internal combustion engine is started by the starter motor even if the additional consumers are active, for example after a short stopping phase of the motor vehicle, ever greater demands are placed on a voltage stability function within the vehicle electrical system.

Published German patent application document DE 103 17 466 A1 describes a circuit configuration which has a starter motor for an internal combustion engine of a motor vehicle and which has a series resistor which is series-connected to the starter motor, namely an NTC series resistor, whose resistance value decreases as the temperature increases. When the starter motor starts up, the NTC series resistor heats up and its resistance value decreases.

Published German patent application document DE 102 31 088 A1 describes a circuit configuration of a starting device for an internal combustion engine of a motor vehicle which has two series-connected transistors, two resistors being connected in parallel to one transistor in each case as a voltage divider to diagnose a short-circuit fault of the transistors in a deactivated state of the transistors.

BRIEF SUMMARY OF THE INVENTION

An object of the present invention is to refine a circuit configuration, a method for operating the circuit configuration and a starting device of the type described above in such a way that an electric machine is operated as easily and in a manner that is as resource-saving as possible.

One idea of the present invention is that the circuit configuration for an electric machine includes a bridging device for bridging a current limiting device, and that a starting current of the electric machine is limited during the startup with the aid of the current limiting device, and the current limiting device is subsequently bridged by the bridging device. The circuit configuration may thus be used to limit the starting current of the electric machine and to operate the electric machine at full power, in particular after the startup, in that the current limiting device is bridged so that, in particular, a maximum current feed is achieved. The electric machine may thus be easily operated with the aid of a current limiting device in that the current limiting device may be deactivated by simply bridging the device. Furthermore, a resource-saving operation of the electric machine is possible, since a more powerfully dimensioned electrical supply or also protective measures for other electrical consumers are avoided by reducing the voltage drop during the startup of the electric machine.

It is preferred that the electric machine be situated in a motor vehicle and, in particular, operated via a battery-fed vehicle electrical system. The current-limiting device may be used to limit the electric load of the vehicle electrical system and still operate the electric machine at a maximum power with the aid of the bridging device, so that the battery of the vehicle electrical system may be dimensioned for less power, i.e., using fewer resources.

The circuit configuration is preferably designed for a starter motor for starting an internal combustion engine in a motor vehicle, so that the electric machine is thus a starter motor.

To start an internal combustion engine, high power is needed which is achieved, in particular, by a high current feed of the starter motor, which, however, results in a voltage drop in the vehicle electrical system. As mentioned above, other vehicle electrical system consumers are affected by this type of voltage drop, in particular in a start-stop system, so that the vehicle electrical system of the motor vehicle may be implemented to save resources in that the starting current of the starter motor is limited during the startup with the aid of the current limiting device, and the internal combustion engine is subsequently safely started at full electrical power by bridging the current limiting device with the aid of the bridging device.

In a preferred specific embodiment, the current limiting device includes a starting resistor, in particular an ohmic resistor, which limits the starting current of the electric machine. The starting resistor may be series-connected to the electric machine and enables a resource-saving and cost-effective current feed of the electric machine, while minimizing the circuit complexity.

The starting resistor may be designed as a line resistor, in particular of an electrical supply line of the electric machine, it being possible to define the starting resistor by suitably selecting the line material, the line length and/or also the line cross section. This makes it possible to reduce the costs and assembly expenditure.

The starting resistor is preferably a discrete resistor element, in particular a metallic conductor. Resistor elements of this type are available in numerous designs, in particular with regard to their resistance value and their current-carrying capacity, and they permit a cost-effective and resource-saving implementation of the circuit configuration.

In particular, a thermal design of the resistor element must be taken into account, since, in particular, a high current is applied to a starter motor and the resistor element is also subjected to enormous temperature fluctuations in a motor vehicle.

The starting resistor may be situated in an engine compartment of the motor vehicle, so that it is easily accessible and permits easy assembly. The starting resistor is preferably provided on the starter motor. The starting resistor and the starter motor may thus be manufactured in a cost-effective and resource-saving manner as a prefabricated, in particular coordinated, module and be easily installed in a plurality of different motor vehicle platforms.

The bridging device is preferably designed to be positively controlled so that no additional control or regulation is needed, in particular as an additional electronic module. The current limiting device may be positively controlled by a rotational speed of the electric machine and preferably in such a way that the current limiting device limits the current feed of the electric machine during the startup of the electric machine, i.e., at low rotational speeds, and the current limiting is deactivated starting at a certain rotational speed by bridging the current limiting device with the aid of the bridging device. An easy and cost-effective starting current limiting function is thus implementable.

The bridging device may be switched by a voltage which drops, in particular, across the electric machine, it being possible to easily use the voltage as an electrical variable to directly switch the bridging device. In particular, a voltage which drops across the electric machine is also conditional upon a voltage which is induced in the electric machine and which rises as the rotational speed increases. Since the voltage dropping across the electric machine thus depends on the rotational speed thereof, the aforementioned positive control may also be easily implemented, in particular, in a rotational speed-controlled manner, minimizing the component complexity.

It is preferred that a starting voltage, which causes the bridging device to switch from a deactivated state to an activated state when the starting voltage is exceeded, amounts to at least 30% and/or a maximum of 70% of a nominal voltage of the electric machine. This ensures that the bridging device switches in an average voltage range and, in particular, a contact chatter, i.e., unintentional switching at low voltage fluctuations, is prevented at an activated or deactivated nominal voltage. It is furthermore ensured that the bridging device remains deactivated when the electric machine is cranked, in that only starting at a certain rotational speed of the electric machine, a certain voltage is induced which corresponds to the starting voltage of the bridging device at which the current limiting device is bridged.

It is furthermore preferred that a turn-off voltage, which causes the bridging device to switch from an activated state to a deactivated state when the voltage drops below the turn-off voltage, amounts to a maximum of 50% of a nominal voltage of the electric machine. This prevents the bridging device from being unintentionally deactivated after it has been activated, since a higher current flow and thus also a voltage drop result directly from the bridging of the current limiting device, the voltage also being able to drop below the starting voltage. Thus, the turn-off voltage is preferably much lower than the starting voltage, for example by at least 30% of the nominal voltage of the electric machine, to guarantee safe activation and deactivation of the bridging device. Reliable switching of the bridging device is thus implementable, virtually by a hysteresis in the voltage-controlled positive control of the bridging device.

It is preferred that the bridging device has an electromechanical switching relay which is situated in the circuit configuration to switch a current path which bridges the current limiting device. This makes it possible to activate and deactivate the current limiting device in a resource-saving manner, namely using little component complexity, simply by switching the switching relay on and off. Similarly to the starting resistor, the switching relay, and in particular additional components of the bridging device, may be situated in the engine compartment and also on the starting device, in particular on the starter motor. A switching relay furthermore permits a long life cycle of the bridging device, and the aforementioned hysteresis of the starting and turn-off voltage may also be implemented using little circuit complexity, namely, for example, with the aid of a suitably dimensioned ferromagnetic circuit and/or restoring springs of the switching relay.

The working current of the switching relay is preferably a maximum of 5 A, so that only a small load is placed on the electrical system of the motor vehicle by the switching relay, and a voltage drop caused by the switching of the switching relay is reduced.

As a preferred embodiment of the present invention, the bridging device is switched by a voltage which drops across the electric machine, as mentioned above. The bridging device may be set to an electrical potential on the electric machine, for example by connecting the relay coil of the switching relay to a terminal of the starter motor via an electric line, so that the current feed of the relay coil is determined directly by the voltage dropping across the starter motor.

This circuit configuration permits a switchable bridging device which is easily implementable, in particular without any additional electronic or electromechanical components.

The bridging device may have a variable resistor which is series-connected to the switching relay, in particular to the relay coil, so that a switching point of the switching relay is settable via the variable resistor. If the bridging device is switched by a voltage, in particular by a voltage dropping across the electric machine, the switching point of the bridging device may be determined or defined with the aid of the variable resistor, in particular with regard to the rotational speed of the electric machine. The variable resistor acts as a voltage divider together with the internal resistance of the relay coil. The variable resistor may have a fixed or a variable resistance value.

The starting and/or turn-off voltage may be defined by a mechanical characteristic of the switching relay, in particular by a suitable design of the relay winding, of an armature, a restoring spring, or also the switching contacts.

In a preferred specific embodiment, the bridging device is designed as a make contact element for bridging the current limiting device in an activated, in particular energized, state of the bridging device. The bridging device must then be activated only after the starting current of the electric machine has been limited, so that an additional voltage drop is avoided during operation of the current limiting device due to the current feed of the bridging device.

As an alternative preferred specific embodiment, the bridging device is designed as a break contact element. The circuit configuration may then be implemented in such a way that the bridging device must be energized only during the startup of the electric machine. This makes it possible to use a greater electrical power for operating the electric machine after startup. Moreover, one of the two aforementioned alternative specific embodiments may be suitably selected for a particular rotational speed-dependent progression of a voltage.

In one preferred specific embodiment, the current limiting device is bridged by the bridging device, in particular upon startup of the electric machine, at a temperature below a temperature limiting value. For example, starting an internal combustion engine at a decreasing temperature requires an increasingly higher power which has to be produced by the starter motor. If the current limiting device is already bridged at the time the electric machine starts up, i.e., if the electric machine is more strongly energized, a greater power or a higher torque is available during the startup. The starter motor may thus be operated from the very beginning with the aid of a full main current to break the internal combustion engine away from a standstill position, in particular at cold temperatures, i.e., at least below the selected temperature limiting value. Therefore, the electric machine, i.e., in particular the internal combustion engine, may be cranked during a cold start at maximum power, namely without current limiting yet at a higher voltage drop, and a current limiting to reduce a voltage drop may be implemented during a warm start, during which additional vehicle electrical system consumers are activated, in particular in a start-stop system.

In a further preferred specific embodiment, the current limiting device includes only one series resistor, which may be short-circuited with the aid of a contact gap of an additional relay. The value of the series resistor is adapted to the requirements. The optimum value for series-resistor RV may be established, for example, as a function of the characteristics of the additional switching relay, for example its winding design or the vehicle electrical system design or of the battery or the state thereof. The best selection for the value of the series resistor may be made on the basis of these variables. The time period during which the series resistor is active, i.e., during which it is not bridged by the contact gap of the relay, may be adapted to the desired characteristics of the system, if necessary in interaction with the resistance value of the series resistor. In this specific embodiment of the present invention, in particular, the minimum of the voltage drop during the startup may be set in such a way that the voltage does not drop below a lower limit for the voltage. This exemplary embodiment according to the present invention has the essential advantage that it may be easily adapted to existing starting systems and thus requires only a small amount of effort if it is to replace a conventional system.

DETAILED DESCRIPTION OF THE INVENTION

Figure 1:
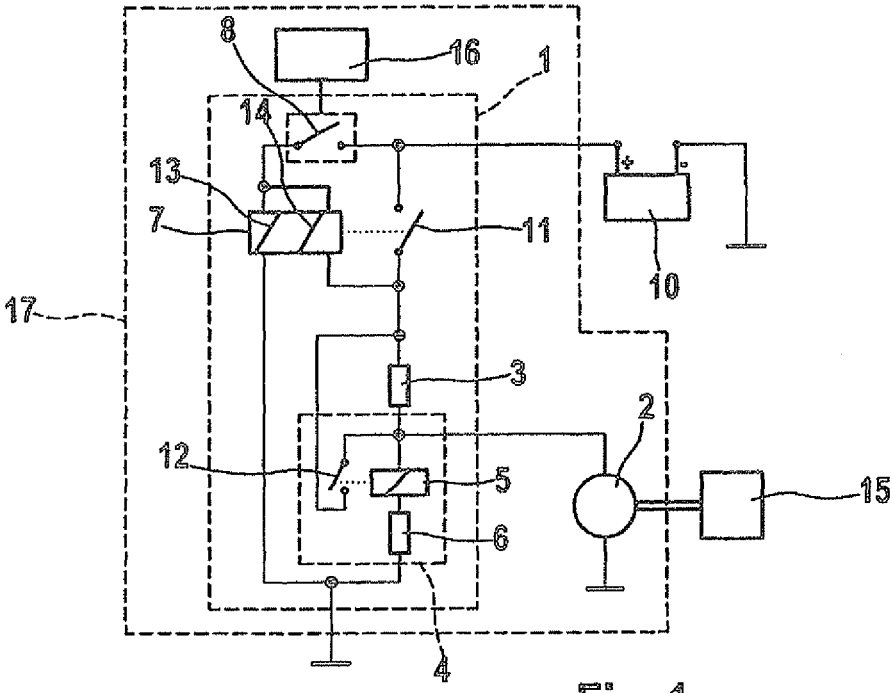
FIG. 1 shows a schematic representation of a starting device having a circuit configuration.

FIG. 1 shows a starting device 17 for starting an internal combustion engine 15 in a motor vehicle, which is not illustrated, including a circuit configuration 1 and a starter motor 2. Circuit configuration 1 is designed for an electric machine 2, namely for starter motor 2, for starting internal combustion engine 15 in the motor vehicle, including a current limiting device 3, namely a starting resistor, for limiting a starting current of starter motor 2. Circuit configuration 1 furthermore includes a bridging device 4 for bridging current limiting device 3, which includes a switching relay 5 and a variable resistor 6. In addition, circuit configuration 1 includes a conventional starter relay 7, which is designed, in particular, to activate and deactivate a current feed of starter motor 2 with the aid of a starter relay contact 11. Circuit configuration 1 is controlled by a start-stop controller 16, which ultimately controls the current feed of starter motor 2 via a switching device 8 for cranking internal combustion engine 15. As alternative exemplary embodiments, switching device 8 may also be controlled via an ignition switch or a starter button on an instrument panel of the motor vehicle.

Current limiting starting resistor 3 limits a starting current of starter motor 2 in circuit configuration 1 in that starting resistor 3 is virtually series-connected to starter motor 2 as a series resistor, only the starting current, in particular, being limited, as will be explained below. Starting resistor 3 is designed as a commercially available, discrete resistor element on the basis of a metallic conductor.

Switching relay 5 of bridging device 4 is designed as a make contact element for bridging starting resistor 3 in a switched, energized state of switching relay 5 in which a switching relay contact 12 is closed.

In this exemplary embodiment, starter relay 7 is provided in a conventional design having a pull-in winding 14 and a holding winding 13 and is situated in an engine compartment of the motor vehicle together with starter motor 2, starting device 17 being designed as a pre-engaged drive starter having continuous excitation.

To start internal combustion engine 15, switching device 8 is actuated by start-stop controller 16, so that a current path including pull-in winding 14, starting resistor 3, and starter motor 2 as well as a current path including holding winding 13 are energized by battery 10. Consequently, starter relay 7 engages and starter relay contact 11 is closed. Due to an engagement of starter relay 7, starter motor 2 is also meshed with a starter pinion in an annular gear of internal combustion engine 15 for a mechanical coupling (not illustrated). Once starter relay contact 11 is closed, pull-in winding 14 is also bridged, and the current consumption of starter relay 7 is reduced, namely to the current feed of holding winding 13. Starter motor 2 is also energized via starter relay contact 11 and starting resistor 3, and it consequently engages, the starting current being limited with the aid of starting resistor 3, thereby also reducing a voltage drop.

Switching relay 5, which is series-connected to variable resistor 6, is connected in parallel to starter motor 2, so that approximately the same voltage as at starter motor 2 is present across switching relay 5 with the aid of variable resistor 6. When starter motor 2 is cranked, only a low voltage drops across the starter motor, and switching relay 5 is opened so that the current feed of starter motor 2 is limited via starting resistor 3. As the rotational speed of starter motor 2 increases, a voltage is induced therein which continues to rise until it reaches a starting voltage of switching relay 5. Consequently, switching relay 5 is increasingly energized and switches to an activated state, so that starting resistor 3 is bridged with the aid of switching relay contact 12, the full voltage available during the current feed by battery 10 is switched to starter motor 2, and a maximum current feed is thus available for the full starter power.

Switching relay 5 is thus positively controlled by the voltage dropping across starter motor 2 in such a way that starting resistor 3 is bridged beginning at a certain rotational speed of starter motor 2. A suitable rotational speed at which bridging device 4, in particular switching relay 5, is switched may be set via variable resistor 6, since it forms a voltage divider for the voltage dropping across starter motor 2 together with an internal resistance of the relay coil of switching relay 5, so that the ratio of the starting voltage of switching relay 5 to the voltage induced in starter motor 2 may be set. Switching relay 5 has a much lower turn-off voltage, compared to the starting voltage, so that, if another voltage drop occurs, it is not released immediately after the bridging of starting resistor 3, i.e., bridging device 4 is not unintentionally turned off.

At the end of the startup, i.e., when switching device 8 opens, the current feed of starter relay 7, in particular of holding winding 13, is interrupted and starter relay contact 11 is opened. Thereafter switching relay 5 disengages with a certain delay, since a voltage, which is induced by the coasting, virtually generator-driven starter motor 2, is still present for the time being. The circuit configuration is then ready again for the next startup.

In this exemplary embodiment, a starter motor 2 having an electrical power between 1 kW and 2.5 kW is preferred, a starting resistance 3 between 2 mOhm and 20 mOhm then being selected. The starting voltage of switching relay 5 amounts to approximately 60% and the turn-off voltage to approximately 30% of the nominal voltage of starter motor 2.

Figure 2:
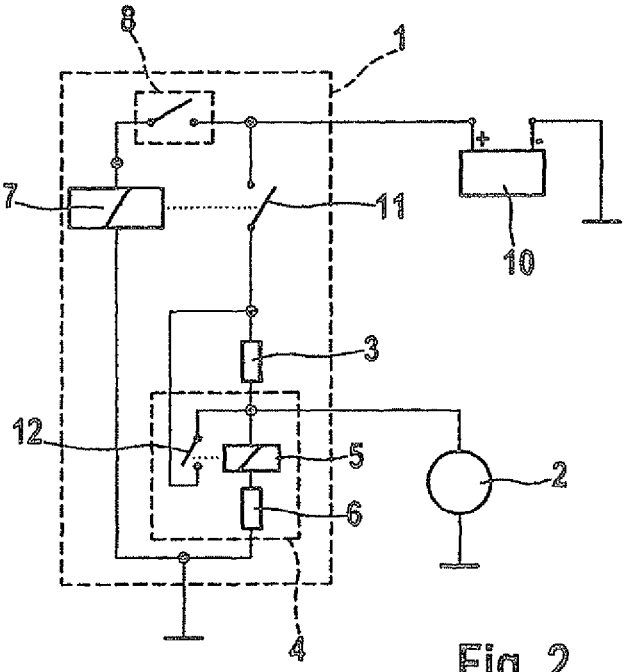
FIG. 2 shows a circuit diagram of another, alternative circuit configuration.

FIG. 2 shows a circuit diagram of another, alternative circuit configuration 1 of starting device 17 according to FIG. 1, which includes the same components as the exemplary embodiment illustrated above, with the exception of a simpler starter relay 7, which has only one winding. A simplified starter relay 7 of this type may be manufactured more cost-effectively and using fewer resources. Furthermore, the preceding explanations also apply without limitation to this exemplary embodiment, with the exception of pull-in winding 14.

Figure 3:
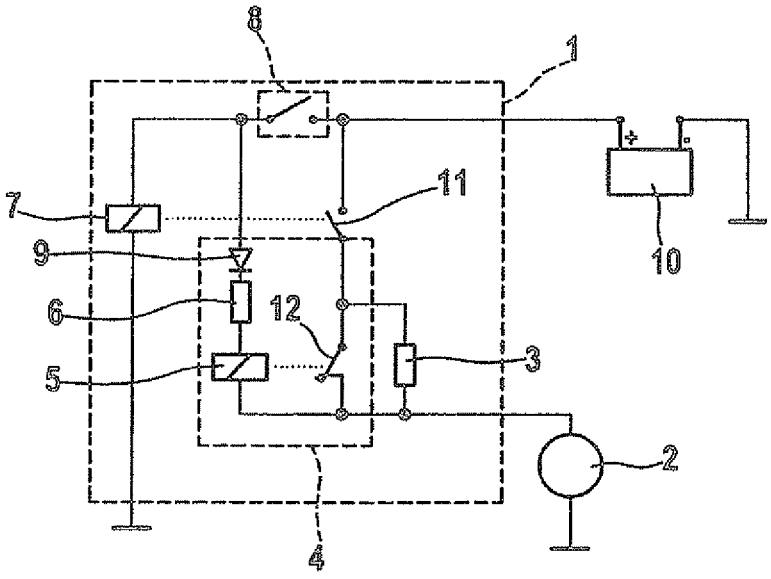
FIG. 3 shows a circuit diagram of a third, alternative circuit configuration.

FIG. 3 shows a circuit diagram of a third, alternative circuit configuration 1 of starting device 17 according to FIG. 1 for starter motor 2 for starting internal combustion engine 15. In this exemplary embodiment, switching relay 5 is designed as a break contact element, i.e., switching relay contact 12 is closed in the de-energized state of switching relay 5. Only the essential differences from the exemplary embodiment illustrated in FIG. 2 are explained below. When switching device 8 is closed, switching relay 5 is initially energized via variable resistor 6 and a diode 9 through starter motor 2, which is still idle at this point in time and then starts up, so that switching relay contact 12 opens and a bridging of starting resistor 3 is canceled. A switching time of switching relay 5 is designed to be much shorter than a switching time of starter relay 7, so that starter relay 7, which is energized when activating switch 8 closes, does not close starter relay contact 11 until after switching relay contact 12 opens, and starter motor 2 is energized by battery 10 via starting resistor 3.

As explained above, an increasing voltage is induced as the rotational speed of starter motor 2 increases, so that, in this circuit configuration 1, the voltage at switching relay 5 increasingly decreases in such a way that it drops below the turn-off voltage of switching relay 5. Consequently, the switching relay contact 12 is opened, the bridging of starting resistor 3 is canceled, and starter motor 2 is energized at the full available voltage, so that the full starter power is available. A power consumption of switching relay 5 is thus reduced after starter motor 2 is cranked.

At the end of the startup, diode 9 prevents, by opening activating switch 8, switching relay 5 from being virtually energized in reverse via still closed starter relay contact 11 and closing again. Diode 9 also prevents starter relay 7 from being further energized via the relay winding of switching relay 5 and thereby being locked.

Other exemplary embodiments, which are not illustrated, differ from the ones described above in that circuit configuration 1 has a temperature-dependent switch which interrupts the bridging of starting resistor 3 at a temperature below a certain limiting value, so that, at temperatures below this limiting value, the full voltage for a maximum current feed, i.e., also a maximum power of starter motor 2, is available as it was already at the startup, i.e., from the very beginning.

Figure 4:
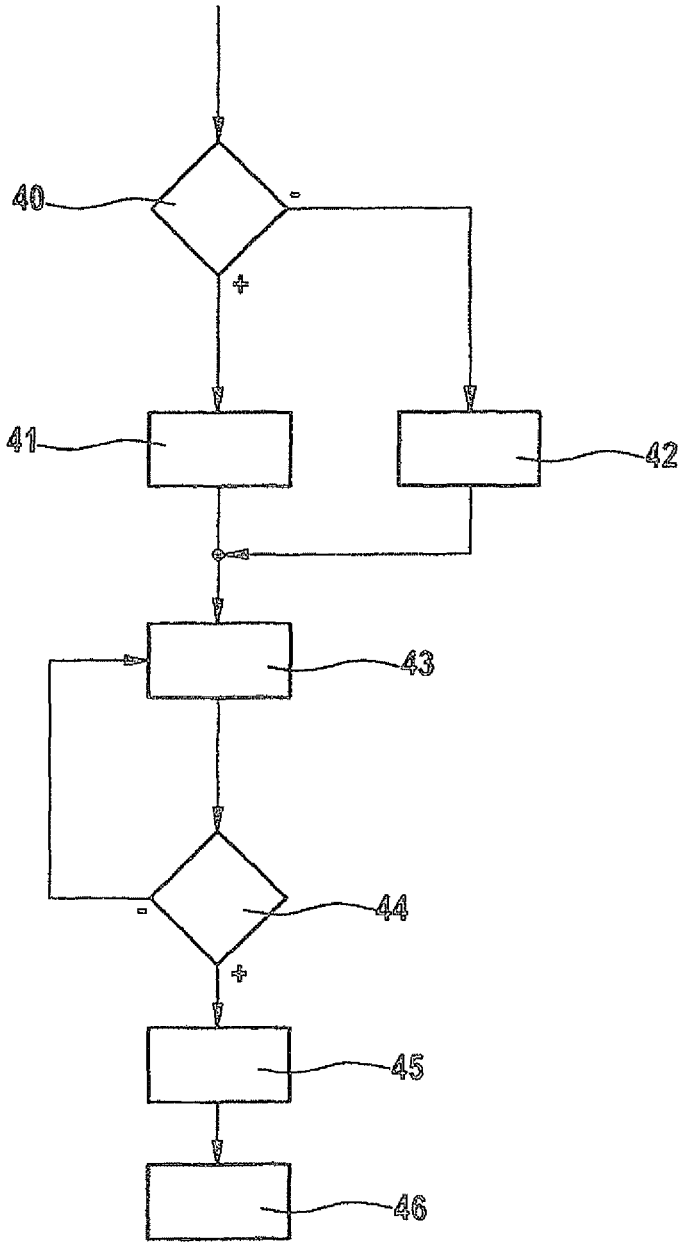
FIG. 4 shows a flow chart for a method for operating a circuit configuration of this type.

FIG. 4 shows a flow chart which has steps of a method for operating circuit configuration 1 and also starting device 17 according to FIGS. 1 through 3.

A step 40 is used to check whether a temperature of starting device 17 has dropped below a certain limiting value. If this is the case, bridging device 4 is turned on in a step 42; otherwise, bridging device 4 remains turned off in a step 41.

In a step 43, starter motor 2 is energized by closing switching device 8 for the purpose of cranking the motor, the starting current being limited by current limiting device 3 as a function of the preceding steps at a temperature at least equal to the limiting value, and current limiting device 3 being bridged by bridging device 4 at a temperature below the limiting value from the beginning of the current feed of starter motor 2, so that the motor is operated at a maximum power, while accepting a maximum voltage drop.

In a step 44, it is virtually checked during cranking of the starter motor with the aid of a positive control whether a certain rotational speed of starter motor 2 has been reached, in that bridging device 4 is controlled by a voltage dropping across starter motor 2. If this is the case, i.e., if the cranking of starter motor 2 by the starting current is completed, bridging device 4 is turned on by positive control in a step 45, or it remains turned on if it was already turned on due to the temperature condition. Finally, starter motor 2 is operated in a step 46 in which current limiting device 3 is bridged for full power without current limiting to start up internal combustion engine 15. All figures show only schematic and not true-to-scale representations. In addition, reference is made, in particular, to the drawings as essential to the present invention.

Figure 5:
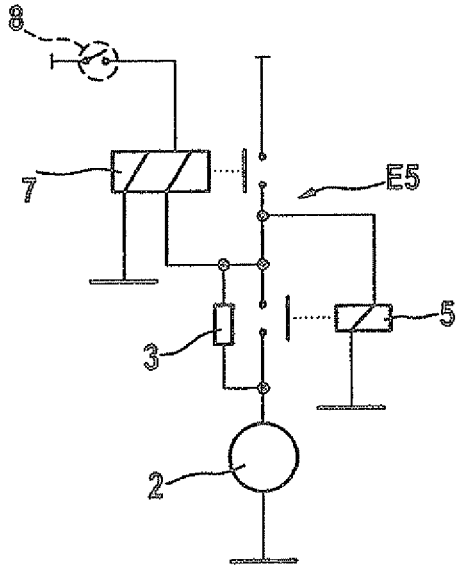
FIG. 5 shows a circuit diagram of a fourth, alternative circuit configuration.

FIG. 5 shows a circuit diagram of a fourth, alternative circuit configuration of a starting device for starter motor 2 for starting the internal combustion engine, which is no longer illustrated herein. In this circuit configuration, current limiting device 3, which is a switched series resistor RV, is located between starter relay 7 and starter motor 2. The contact gap of an additional switching relay 5 is switchable in parallel to switched series resistor RV. Input E5 for additional switching relay 5 is connected to switching contact T45 of starter relay 7. The voltage supply for the additional switching relay is implemented via this connection. The other switching contact of starter relay 7 is identified by T30. Switching device 8 is, for example, the ignition switch, which actuates starter relay 7.

The circuit configuration according to FIG. 5 may be used to optimally reduce the voltage drop during the startup. No additional changes are required for installation in conventional starting systems, so that replacements are easily made.

Switched series resistor RV of current limiting device 3 is activated for a brief period of time RVt. During the remaining time, it is bridged by the contact gap of switching relay 5. The optimum value for series-resistor RV depends, for example, on the characteristics of additional switching relay 5, for example its winding design or the vehicle electrical system design or on the battery or the state thereof. The best selection for the value of the series resistor may be made on the basis of these variables. The targeted voltage reduction or the targeted reduction in the voltage drop during the startup may be varied by selecting the resistance value for RV and/or time RVt during which the series resistor is not bridged.

Figure 6:
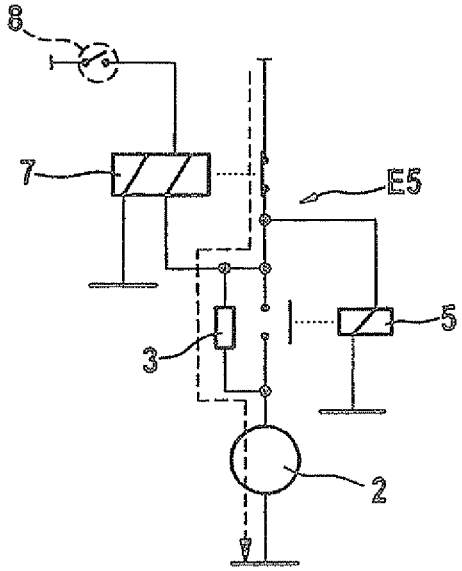
FIG. 6 shows a circuit diagram of the fourth, alternative circuit configuration which has closed contacts on the starter relay.
Figure 7:
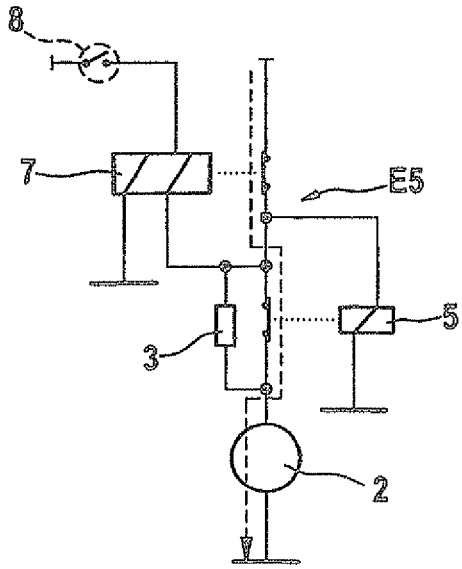
FIG. 7 shows a circuit diagram of the fourth, alternative circuit configuration which has closed contacts on the starter relay and on the additional switching relay.

FIGS. 6 and 7 show the circuit diagram of the fourth, alternative circuit configuration in two different switching states. The respective current flow is plotted as a broken line. In FIG. 6, the starter relay is activated, and contacts T30 and T45 are closed or connected to each other. Starter relay 7 has thus engaged, and the starter pinion is meshed with the annular gear. Additional relay 5 is open. The main current flows through series resistor RV and is limited thereby.

If voltage is applied to additional relay 5 via terminal T45 of the starter relay, the additional relay engages; the contacts are closed and bridge series resistor RV. The current flowing through series resistor RV decreases dramatically and the current flows directly from terminal T30 through starter motor 2. The activation or time RVt during which series resistor RV is active is dependent only on the activation time of additional relay 5.

Figure 8:
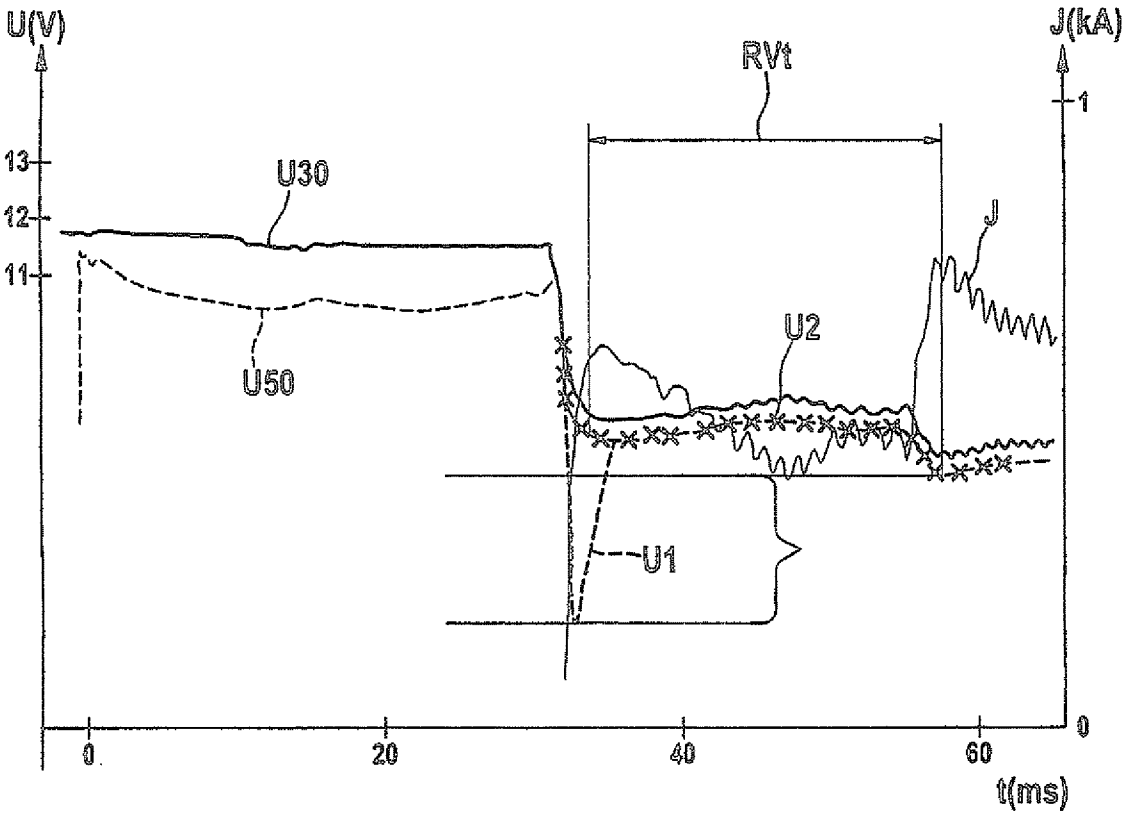
FIG. 8 shows different voltage and current curves over time, which illustrate the advantages of the circuit configuration according to the present invention on the basis of FIGS. 5 through 7.

FIG. 8 shows different voltage and current curves over time, which illustrate the advantages of the circuit configuration according to the present invention on the basis of FIGS. 5 through 7. Specifically, these curves are: Voltage U30 is the voltage present at terminal 30. Voltage U1 is the voltage which would occur after activating the starter if no series resistor RV were present. U2 is maintained by series resistor RV. U50 is another voltage in the vehicle electrical system, and I represents a current curve. Time RVt is the time during which series resistor RV is not bridged, and UD is the difference U2 min−U1 min of the minimum voltages of U1 and U2 which occur during the startup. According to the present invention, the voltage drop is improved by UD with the aid of series resistor RV.

Time period RVt of the bridging of current limiting device 3 is adaptable to predefinable requirements. Time period (RVt) of the bridging of the current limiting device with the aid of additional relay 5 begins, for example, shortly after starter relay 7 is activated and ends approximately 10 to 30 milliseconds thereafter. The desired time period may be selected using characteristics of the additional relay, for example, its holding period, or by external activation of the additional relay at predefinable times or similar measures.

What is claimed is:

1. A circuit configuration for a starter motor for starting an internal combustion engine in a motor vehicle, comprising:

a current limiting device to limit a starting current of the starter motor; and a bridging device for bridging the current limiting device;

wherein the bridging device includes a switching relay and a resistor, wherein an internal resistance of the switching relay coil and the resistor form a voltage divider for a voltage dropping across the starter motor, and wherein the bridging device is positively control able by the voltage dropping across the starter motor in such a way that the current limiting device is bridged beginning at a certain rotational speed.

2. The circuit configuration as recited in claim 1, wherein the current limiting device includes one of a starting resistor or a series resistor limiting the starting current of the starter motor.

3. The circuit configuration as recited in claim 2, wherein the one of the starting resistor or series resistor is a discrete resistor element in the form of a metallic conductor.

4. The circuit configuration as recited in claim 2, wherein the one of the starting resistor or series resistor is provided on the starter motor.

5. A circuit configuration for a starter motor for starting an internal combustion engine in a motor vehicle, comprising:

a current limiting device to limit a starting current of the starter motor; and a bridging device to bridge the current limiting device, wherein the bridging device is switched by a voltage drop across the starter motor.

6. The circuit configuration as recited in claim 5, wherein a starting voltage is predefined, and wherein the bridging device switches from a deactivated state to an activated state when the voltage drop across the starter motor exceeds the starting voltage, and wherein the starting voltage is at least one of: (i) at least 30% of a nominal voltage of the starter motor, and (ii) a maximum of 70% of the nominal voltage of the starter motor.

7. The circuit configuration as recited in claim 5, wherein a turn-off voltage is predefined, and wherein the bridging device switches from the activated state to the deactivated state when the voltage drop across the starter motor falls below the turn-off voltage, and wherein the turn-off voltage is a maximum of 50% of a nominal voltage of the electric machine.

8. The circuit configuration as recited in claim 7, wherein the bridging device has an electromechanical switching relay and a variable resistor series-connected to the switching relay.

9. The circuit configuration as recited in claim 8, wherein the bridging device is an element configured to selectively make contact.

10. The circuit configuration as recited in claim 8, wherein the bridging device is an element configured to selectively break contact.

11. The circuit configuration as recited in claim 8, wherein the series resistor is bridged with the aid of the electromechanical switching relay.

12. A method for operating a circuit configuration for a starter motor for starting an internal combustion engine in a motor vehicle, the circuit configuration including a current limiting device for limiting a starting current of the starter motor and a bridging device, the method comprising:

bridging, upon startup of the starter motor, the current limiting device by the bridging device at a temperature below a temperature limiting value.

13. The method as recited in claim 12, wherein the current limiting device is bridged with the aid of a contact gap of an additional relay during a predefined time period.

14. The method as recited in claim 13, wherein the time period for bridging the current limiting device is adapted to predefined requirements.

15. The method as recited in claim 13, wherein the time period for bridging the current limiting device begins after the starter relay is activated and continues for approximately 10 to 30 milliseconds.

16. The method as recited in claim 12, wherein the current limiting device includes one of a starting resistor or a series resistor limiting the starting current of the starter motor.

17. The method as recited in claim 16, wherein the one of the starting resistor or series resistor is a discrete resistor element in the form of a metallic conductor.

18. The method as recited in claim 16, wherein the one of the starting resistor or series resistor is provided on the starter motor.

19. The method as recited in claim 12, wherein a starting voltage is predefined, and wherein the bridging device switches from a deactivated state to an activated state when the voltage drop across the starter motor exceeds the starting voltage, and wherein the starting voltage is at least one of: (i) at least 30% of a nominal voltage of the starter motor, and (ii) a maximum of 70% of the nominal voltage of the starter motor.

20. The method as recited in claim 12, wherein a turn-off voltage is predefined, and wherein the bridging device switches from the activated state to the deactivated state when the voltage drop across the starter motor falls below the turn-off voltage, and wherein the turn-off voltage is a maximum of 50% of a nominal voltage of the electric machine.

21. The method as recited in claim 20, wherein the bridging device has an electromechanical switching relay and a variable resistor series-connected to the switching relay.

22. The method as recited in claim 21, wherein the bridging device is an element configured to selectively make contact.

23. The method as recited in claim 21, wherein the bridging device is an element configured to selectively break contact.

24. The method as recited in claim 21, wherein the series resistor is bridged with the aid of the electromechanical switching relay.

* * * * *